US008657075B2

(12) United States Patent
Sanz Gamboa

(10) Patent No.: US 8,657,075 B2
(45) Date of Patent: Feb. 25, 2014

(54) LIFT GUIDE

(75) Inventor: Jesús Sanz Gamboa, Vera de Bidasoa (ES)

(73) Assignee: S.A. de Vera (Savera), Vera de Bidasoa (Navarra) (ES)

( * ) Notice: Subject to any disclaimer, the term of this patent is extended or adjusted under 35 U.S.C. 154(b) by 599 days.

(21) Appl. No.: 12/989,847

(22) PCT Filed: May 28, 2009

(86) PCT No.: PCT/ES2009/000299

§ 371 (c)(1),
(2), (4) Date: Oct. 27, 2010

(87) PCT Pub. No.: WO2009/147260

PCT Pub. Date: Dec. 10, 2009

(65) Prior Publication Data

US 2011/0036670 A1 Feb. 17, 2011

(30) Foreign Application Priority Data

Jun. 6, 2008 (ES) ..... 200801760

(51) Int. Cl.
*B66B 7/02* (2006.01)

(52) U.S. Cl.
USPC ..... 187/406; 104/127

(58) Field of Classification Search
CPC ..... B66B 7/02
USPC ..... 187/406; 104/127
See application file for complete search history.

(56) References Cited

U.S. PATENT DOCUMENTS 1,931,237 A 10/1933 O'Connell et al.
6,006,867 A * 12/1999 Richter et al. ..... 187/410
8,020,671 B2 * 9/2011 Kocher et al. ..... 187/351

FOREIGN PATENT DOCUMENTS

JP 1123680 U 8/1989

OTHER PUBLICATIONS

US 6006867 Mark Up of Fig. 2.*
US 8020671 Mark Up of Fig. 3.*

* cited by examiner

*Primary Examiner* — William E Dondero
*Assistant Examiner* — Diem Tran
(74) *Attorney, Agent, or Firm* — Lucas & Mercanti, LLP

(57) ABSTRACT

The invention relates to a lift guide with a symmetry axis OY, consisting of a mushroom-shaped element and two flanges, each side of the mushroom element being provided with a side braking and guiding surface for the lift-braking and -guiding elements. The invention is characterized in that the mushroom element includes a head which limits movement of the braking and/or guiding elements along the axis. The head of the mushroom element has: two side braking and/or rolling surfaces, on either side of the symmetry axis, which converge toward one another in the direction of the interior or exterior of the mushroom element; and larger dimensions along the OX axis than the side braking/guiding surfaces.

3 Claims, 6 Drawing Sheets

LIFT GUIDE

CROSS REFERENCE TO RELATED APPLICATIONS

This application is a 371 of PCT/ES2009/000299 filed May 28, 2009, which in turn claims the priority of ES P200801760 filed Jun. 6, 2008, the priority of both applications is hereby claimed and both applications are incorporated by reference herein.

The object of the invention is a new lift guide.

An unresolved problem present in current (known) lift guides is that of safety, particularly with regard to preventing the guides from coming out of the cabin and the counterweight and maintaining the overspeed brakes, when they operate, inside the guides.

This problem is accentuated, for example, in seismic zones, which are very critical with regard to the derailing of the lift and especially to of the counterweight which, due to the accelerations caused when earthquakes occur, come off the guides and strike against the cabin.

The new lift guide, according to the invention, limits movements in two directions, while the current (known) guides only limit it in one direction. For this purpose, the lift guide, according to the invention, being of the type made with a symmetry axis $\overline{OY}$ and which consists of a mushroom element and two flanges, each side of the mushroom element being provided with a side braking and guiding surface for the braking and guiding elements of the lift; it is characterized in that the mushroom element consists of a head which limits the movement of the braking and/or guiding elements along the $\overline{OY}$ axis.

The following is included in the new lift guide that is the object of the invention:

The mushroom-button head has, on each side of the symmetry axis $\overline{OY}$, two side braking and/or rolling surfaces converging toward one other, in the direction of the interior or the exterior of the mushroom element.

At least one of the side surfaces is curved, and

The head has larger dimensions along the $\overline{OX}$ axis than the side braking/guiding surfaces.

Other additional advantages of the lift guides according to the invention are deduced from the description and figures represented in the attached diagrams in which.

Figure 1:
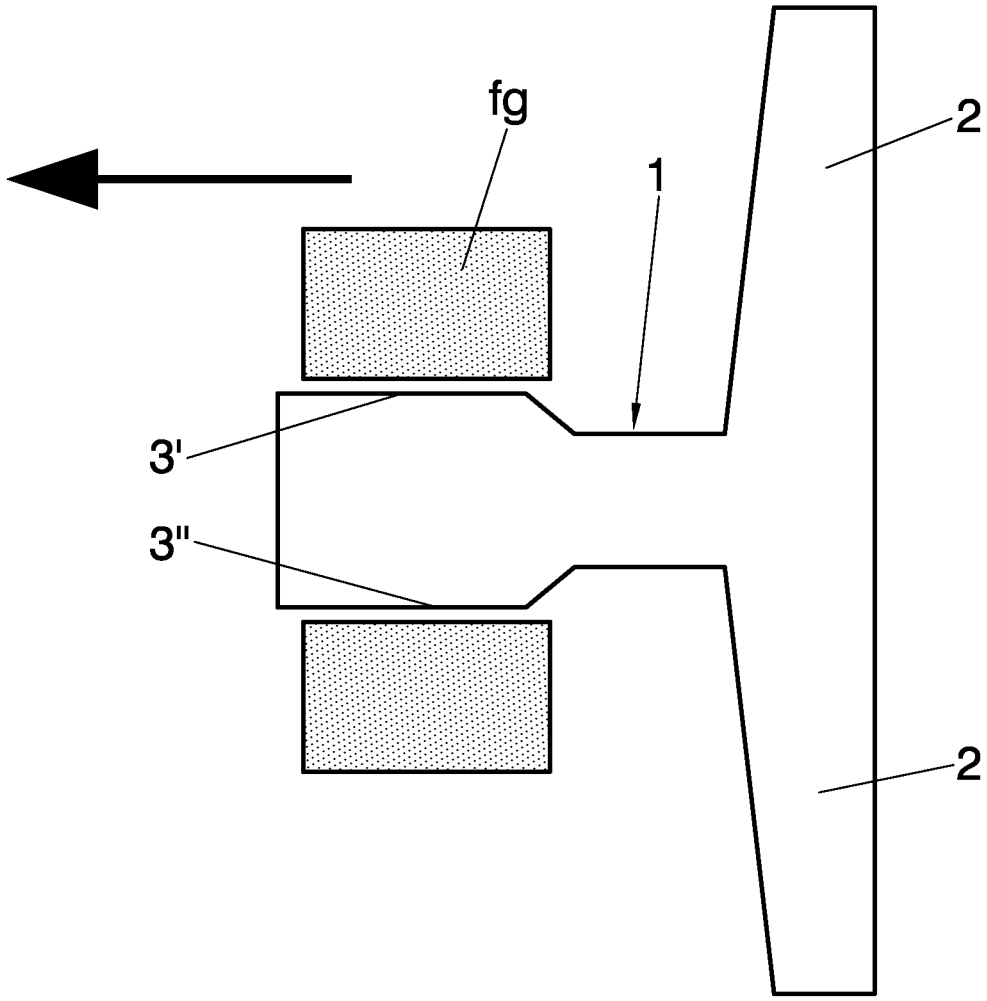
FIG. 1 represents a general cross-section of the known lift guides.
Figure 2:
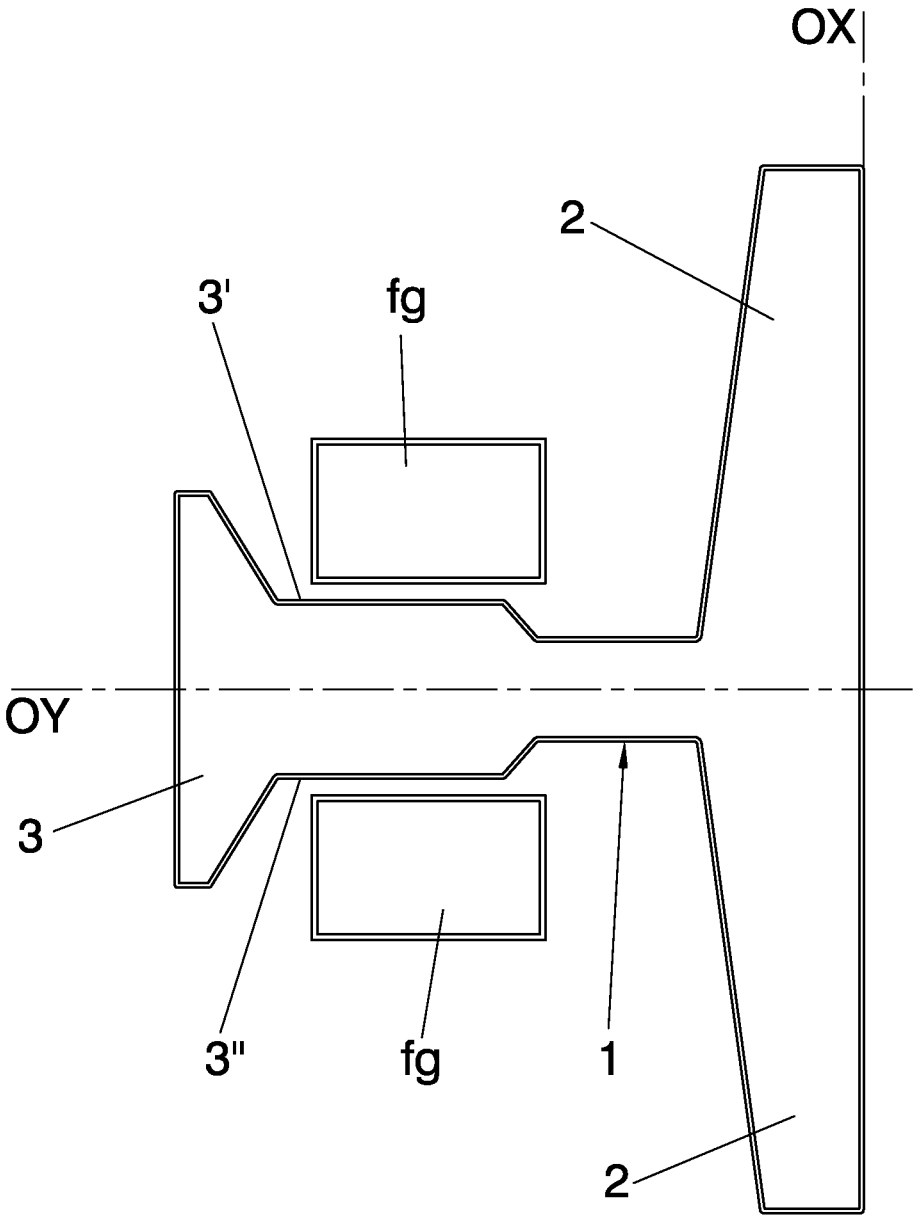
FIG. 2 represents a general cross-section of the lift guides, according to the invention.

FIGS. 3*a* to 3*e* schematically represent general cross-sections of lift guides according to the invention similar to FIG. 2 and for practical alternative embodiments.

An example of practical, non-limiting embodiment of this invention is described as follows:

The lift guide, according to the invention, is of the type made up of a symmetry axis $\overline{OY}$ and which consists of mushroom core (1) and side flanges (2); each side of the mushroom element (1) being provided with a side braking and guiding surface (3'), (3") for the braking and guiding elements (fg) of the lift.

According to the invention—see FIG. 2—, the mushroom element (1) consists of a head (3) that limits the movement of the braking and/or guiding elements (fg) along the $\overline{OY}$ axis. It is basic for the purposes of the invention that said head (3)—see FIG. 3*a*—should have larger dimensions (Δ) along the $\overline{OX}$ axis than the side braking/guiding surfaces (3'), (3).

Based on this basic concept, any practical alternative embodiments of guides that do not essentially alter, change or modify the proposal are interchangeable and are included in the object of the invention.

Figure 3A:
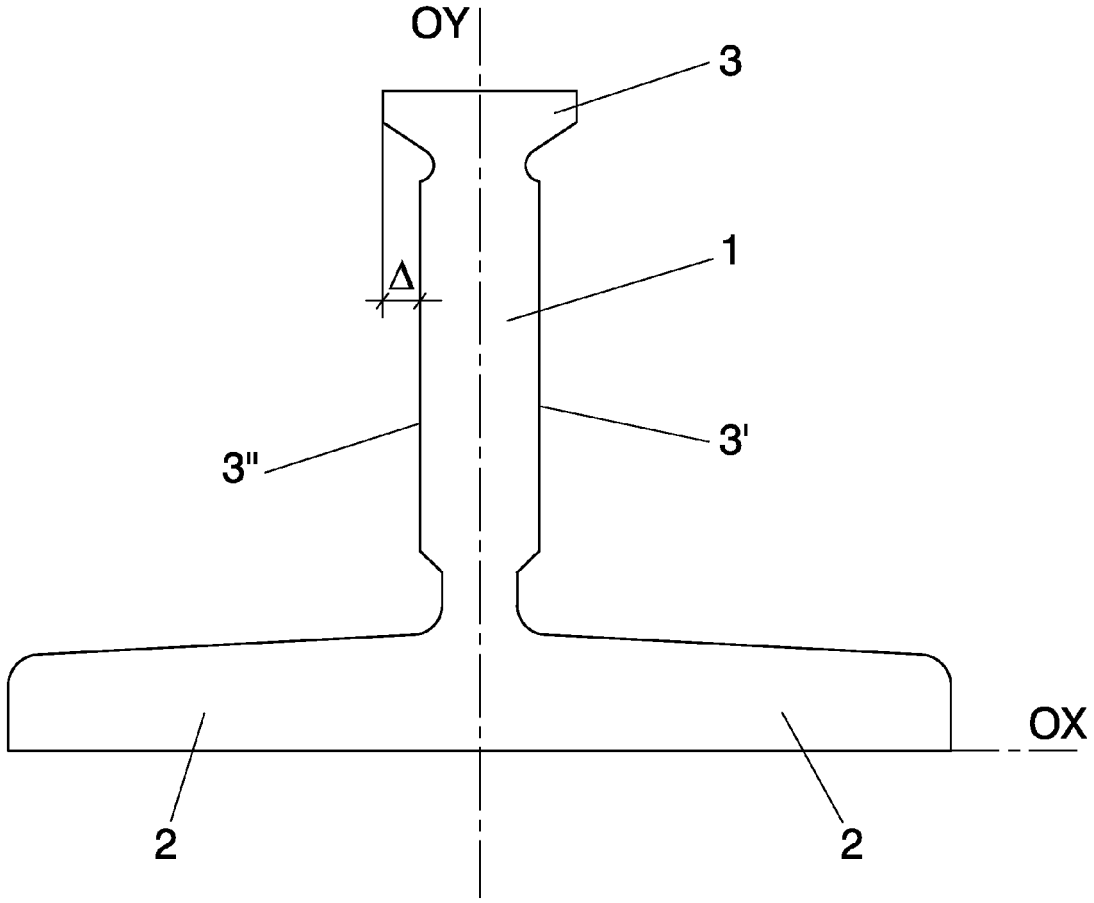

According to the embodiment represented in FIG. 3*a*, the mushroom element (1) defines in itself the side braking and guiding surfaces (3'), (3") for the braking and guiding elements (fg) of the lift.

Figure 3B:
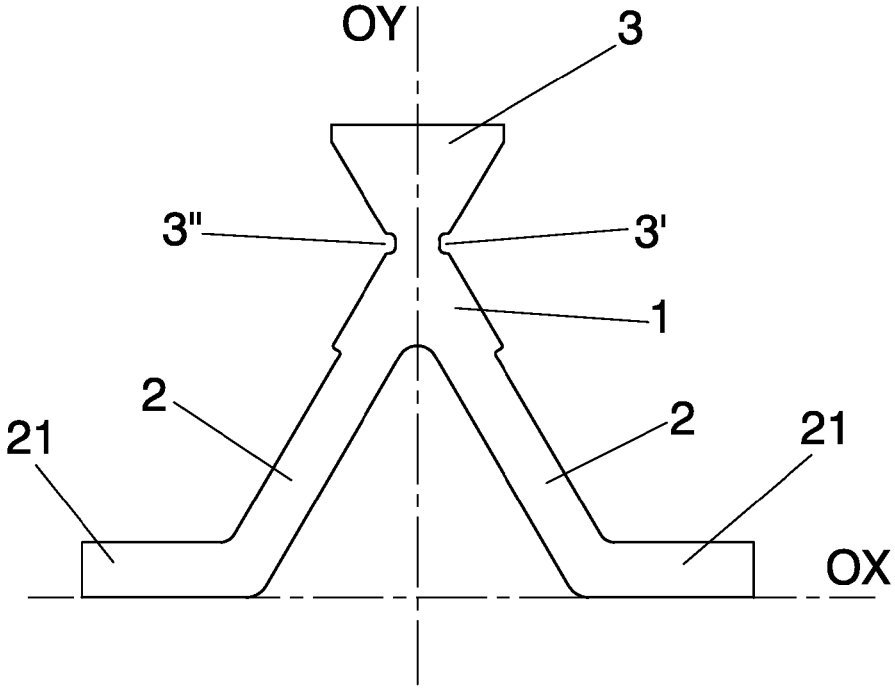

According to the embodiment represented in FIG. 3*b*, the mushroom element (1) and the head (3) define, in their conjunction, the to side braking and guiding surfaces (3'), (3") for the braking and guiding elements (fg) of the life. The flanges (2) are not coplanar, but rather oblique with respect to each other and have end support projections (21).

Figure 3C:
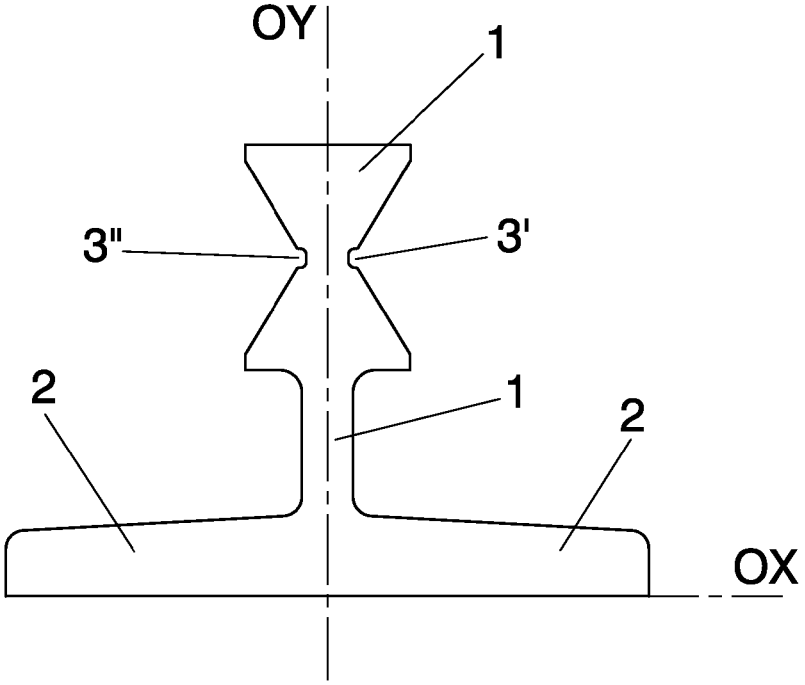
Figure 3D:
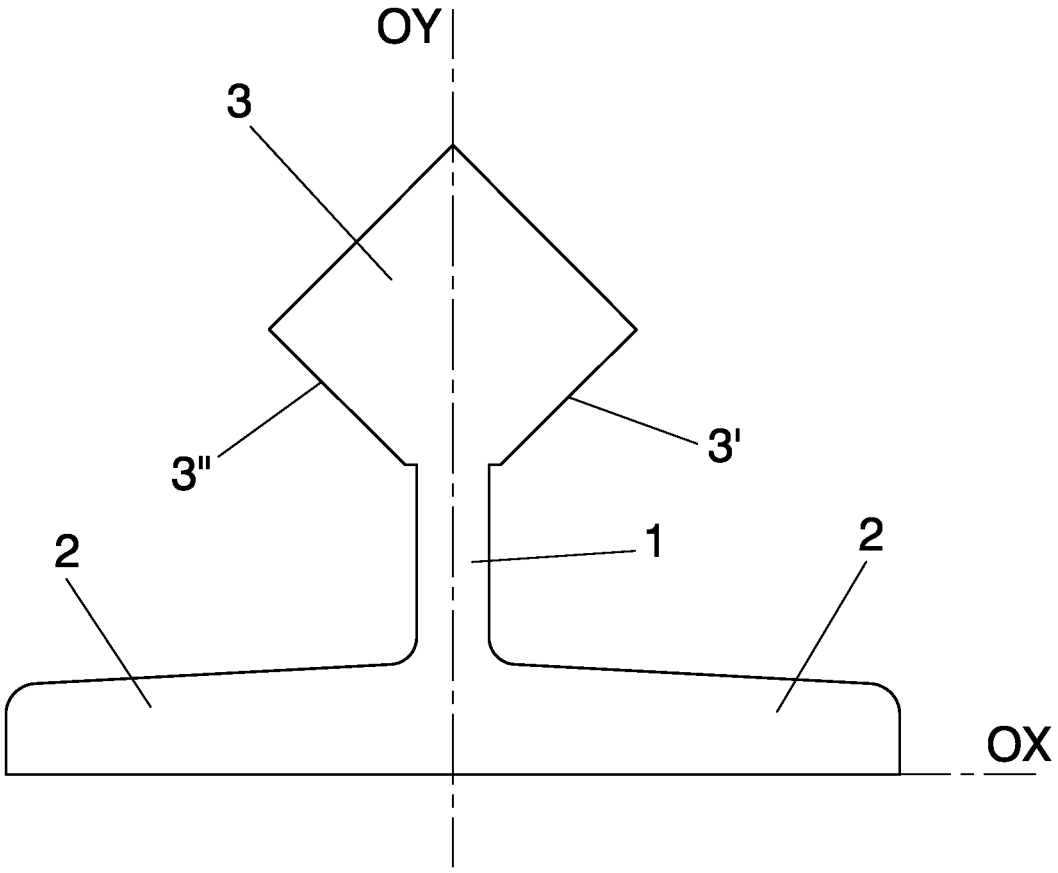
Figure 3E:
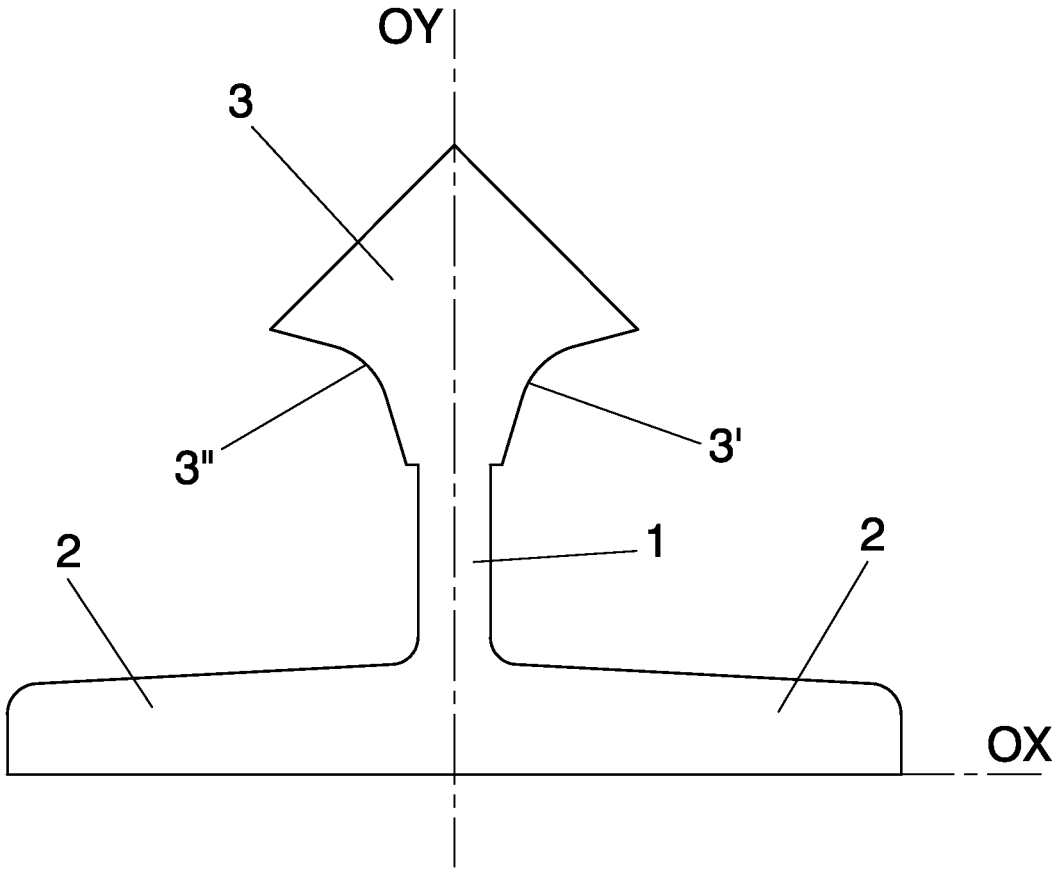

According to the embodiments represented in FIGS. 3*c* and 3*d*, the side braking and guiding surfaces (3'), (3") for the braking and guiding elements (fg) of the lift are defined on the head itself (3): some in concavity—FIG. 3*c*—and others in convexity—FIG. 3*d*—.

In the embodiments represented, the side braking and guiding surfaces (3'), (3") for the braking and guiding elements (fg) of the lift, irrespectively of whether they are defined in the mushroom element (1) or in the head (3) are straight. In the lift guide, according to the invention, it is also indicated that said side surfaces will be curved (concave—as in FIG. 3*e*—or convex) without essentially altering the invention as a result.

The invention claimed is:

1. A lift guide, with a longitudinal symmetry axis comprising:

a mushroom element having bilateral symmetry;

the mushroom element having a head at one longitudinal end of the mushroom element, two flanges at another end of the mushroom element, and a connecting portion extending longitudinally between and connecting the head to the flanges, two side surfaces on the head, each side surface having braking and guiding surfaces, the braking and guiding surfaces adapted for movement of braking and guiding elements along the longitudinal symmetry axis of the guide; and having a portion with a larger dimension than the side surfaces along a perpendicular axis with respect to the longitudinal symmetry axis, the side surfaces being between the portion of the head with the larger dimension and the connection portion, such that the portion of the head with the larger dimension limits movement of the braking and guiding elements along the side surfaces and the longitudinal symmetry axis.

2. The lift guide according to claim 1, wherein the head of the mushroom element has, on each side two braking and guiding surfaces converging toward one another in a direction of an interior or an exterior of the mushroom element.

3. The lift guide according to claim 2, wherein at least one of said braking and guiding surfaces is curved.

* * * * *